United States Patent [19]

Wiese

[11] Patent Number: 4,498,714

[45] Date of Patent: Feb. 12, 1985

[54] OVERHEAD RETAIL MERCHANDISING UNIT FOR CIGARETTES

[75] Inventor: Lee Wiese, Upper Nyack, N.Y.

[73] Assignee: Philip Morris Incorporated, New York, N.Y.

[21] Appl. No.: 464,868

[22] Filed: Feb. 8, 1983

[51] Int. Cl.[3] ..... A47B 57/10

[52] U.S. Cl. ..... 312/312; 211/49 D; 312/40; 312/270

[58] Field of Search ..... 312/40, 270, 312; 211/490, 131, 207; 5/11; 108/147; 403/104

[56] References Cited

U.S. PATENT DOCUMENTS

| | | | |
|---|---|---|---|
| 217,516 | 7/1879 | Butts | 312/312 |
| 364,684 | 6/1887 | Sonne . | |
| 668,627 | 2/1901 | Crow | 108/147 |
| 929,457 | 7/1909 | Macon | 312/312 |
| 1,486,176 | 3/1924 | Wolters | 312/312 |
| 2,054,327 | 9/1936 | Jeck . | |
| 2,120,327 | 6/1938 | Elsaesser . | |
| 2,368,748 | 2/1945 | Doty | 108/147 |
| 2,473,239 | 6/1949 | Boyd . | |
| 2,635,030 | 4/1953 | Stebbins et al. . | |
| 2,687,934 | 8/1954 | Gipple . | |
| 2,781,037 | 2/1957 | Vuncannon . | |
| 2,802,711 | 8/1957 | Ulrich, Sr. . | |
| 2,888,308 | 5/1959 | Devine et al. . | |
| 2,891,677 | 10/1953 | Ritchie | 211/59.2 |
| 2,910,335 | 10/1959 | Wales . | |
| 3,081,138 | 3/1963 | Stebbins . | |
| 3,154,029 | 10/1964 | Bronson | 211/59.3 |
| 3,415,586 | 12/1968 | Hammond | 312/312 |
| 3,492,702 | 2/1970 | Stafford | 403/104 |
| 3,778,125 | 12/1973 | Gutmann, Jr. et al. . | |
| 4,073,555 | 2/1978 | Noren . | |

OTHER PUBLICATIONS

R. J. Reynolds Tobacco Company Overhead Package Merchandiser, *1981 Point of Purchase Advertising Institute Awards Book*, p. 14.

Brown & Williamson Tobacco Corporation Space--saver Overhead Merchandising System, *C-Store Business*, Sep. 1982, p. 17.

Stak-Pak Cigarette Merchandising System sales brochure.

*Primary Examiner*—William E. Lyddane
*Assistant Examiner*—Joseph Falk
*Attorney, Agent, or Firm*—Jeffrey H. Ingerman

[57] ABSTRACT

An overhead retail merchandising display for cigarettes is provided. The height of the display is continuously adjustable to the varying heights of store personnel. The display is distinctive and attractive in appearance, while at the same time being simple to construct and operate. It is supported by generally upright posts which preferably telescope so that they can be adjusted to the height requirements of a given installation. For finer adjustment to the height of store personnel, it is provided with a mechanism for raising and lowering it on the upright posts and retaining it in any selected position.

9 Claims, 4 Drawing Figures

101
102
103
104
105
106
107
108
109
110
111
112
113
114
115
116
408
410
411
420

OVERHEAD RETAIL MERCHANDISING UNIT FOR CIGARETTES

BACKGROUND OF THE INVENTION

This invention relates to overhead merchandise displays for use in retail establishments, and more particularly to an overhead cigarette pack merchandiser which can be adjusted to accommodate the particular heights of individual store personnel.

Overhead merchandise displays are well known in the retailing field, particularly for use with small items and especially those which are available in a large variety of sizes or brands. Located above the counter of a retail store, these displays help prevent theft, because the items are accessible only to the store clerk. At the same time, the clerk need not divert his eyes from the rest of the store while selecting the item requested. The displays also encourage impulse buying by displaying fast-moving, high-profit items to the customer while he waits for service.

These units are generally supported by columns from below, or by columns or chains from the ceiling. They are open only at the rear, facing the sales clerk, while the front and sides, which are closed, can carry advertising which may, for example, indicate to customers the type of merchandise within. Alternatively, the front and side panels may be fully or partly transparent, affording the customers a view of the contents. These two features can be combined, so that the panels are partly transparent, with the non-transparent portion bearing advertising. Hooks can be provided on the exteriors of the side and front panels for hanging other types of merchandise often bought on impulse.

For example, one type of overhead cigarette display in use is supported by posts from either above or below. The front side, facing the customers, carries backlit advertising transparencies for various cigarette brands, surrounding a lighted clock or other customer-attracting feature. Cigarettes are held in wire mesh drawers within the enclosure, accessible to the clerk from the rear. The drawers are positioned at an angle, so that each time a pack is removed a new one is fed by gravity to the position vacated by the first pack. The drawers are mounted on standard track and glide mounts, such as those used in filing cabinets, which allow them to slide down for easy stocking.

Another known type of overhead cigarette merchandising display is supported by posts from below. In this display, cigarettes are stored in a succession of vertical magazines mounted on tracks or glides for vertical movement. Each magazine comprises several columnar sub-magazines which dispense cigarette packs from the bottom. As a pack is removed, the remaining packs in that column shift downward, so that another pack takes the place of the one removed. The bottom of each successive vertical magazine is lower than that of the one before it, with the magazine closest to the clerk the highest. By virture of this stepped arrangement, the clerk has access to the bottom of each column without moving any of the magazines. The height of each "step" is such that several packs of each brand are visible. The magazines can be reloaded by lowering them on their tracks, allowing access to the tops of the columns. Both the front and rear panels of the display can carry advertising.

A third known type of overhead merchandise display is supported by chains from above. The cigarette packs are stored in columns which are gravity-fed as described above in connection with the second type of display. The side facing the customer can be completely transparent, or can be fitted with one of a number of additional merchandising aids. One such aid could be manufacturer's advertising, or a "reader board" on which the storekeeper can display any desired message such as special sales, seasonal messages, or menus (in the case of a foodservice counter). Another available merchandising aid with which the exterior panels can be equipped is a pegboard on which other items often bought on impulse, such as photographic film, razor blades, batteries and other items, can be displayed. Both of these aids leave a portion of the transparent panel visible so that the customer can see the brands of cigarettes that are available.

These overhead displays have not proven to be completely satisfactory. First, they are all generally box-like in appearance, and are not especially attractive even after the addition of sometimes elaborate electrified advertising. Second, and more important, they lack the necessary degree of height adjustability.

In selecting the height at which an overhead merchandising display is mounted, there are two competing considerations. One is that the unit should be low enough that the shortest clerk who will be staffing the counter can reach it without undue discomfort. The other is that it should be high enough that the tallest clerk can see under it clearly, without stooping.

The height of many of the conventional units described can be changed, but only by coarse, discrete adjustments which require at least partial disassembly of the unit, and are usually made, in practice, only at the initial installation.

SUMMARY OF THE INVENTION

It is an object of this invention to provide an overhead cigarette merchandising display the height of which is easily and continuously adjustable to accommodate the varying heights of store personnel.

It is a further object of this invention to provide such an adjustable display which has an attractive and distinctive appearance.

It is still another object of this invention to provide such a display which is as simple to construct and operate as possible.

The present invention comprises an overhead retail merchandising unit for cigarettes which has an elongated cigarette dispensing enclosure which is closed on its top, bottom, sides, and front, and open at its rear. The unit is supported by upright posts which are slidably received in upright passages in the enclosure. Means are provided in the enclosure for translating it relative to the upright supports and for retaining it at the desired height once adjusted. The supports are additionally capable of coarse height adjustments to a limited number of discrete positions.

Other objects and advantages of the invention will become apparent to one skilled in the art upon reading the following detailed description with the accompanying drawings, in which like reference characters refer to like parts throughout.

DESCRIPTION OF THE PREFERRED EMBODIMENT

Figure 1:
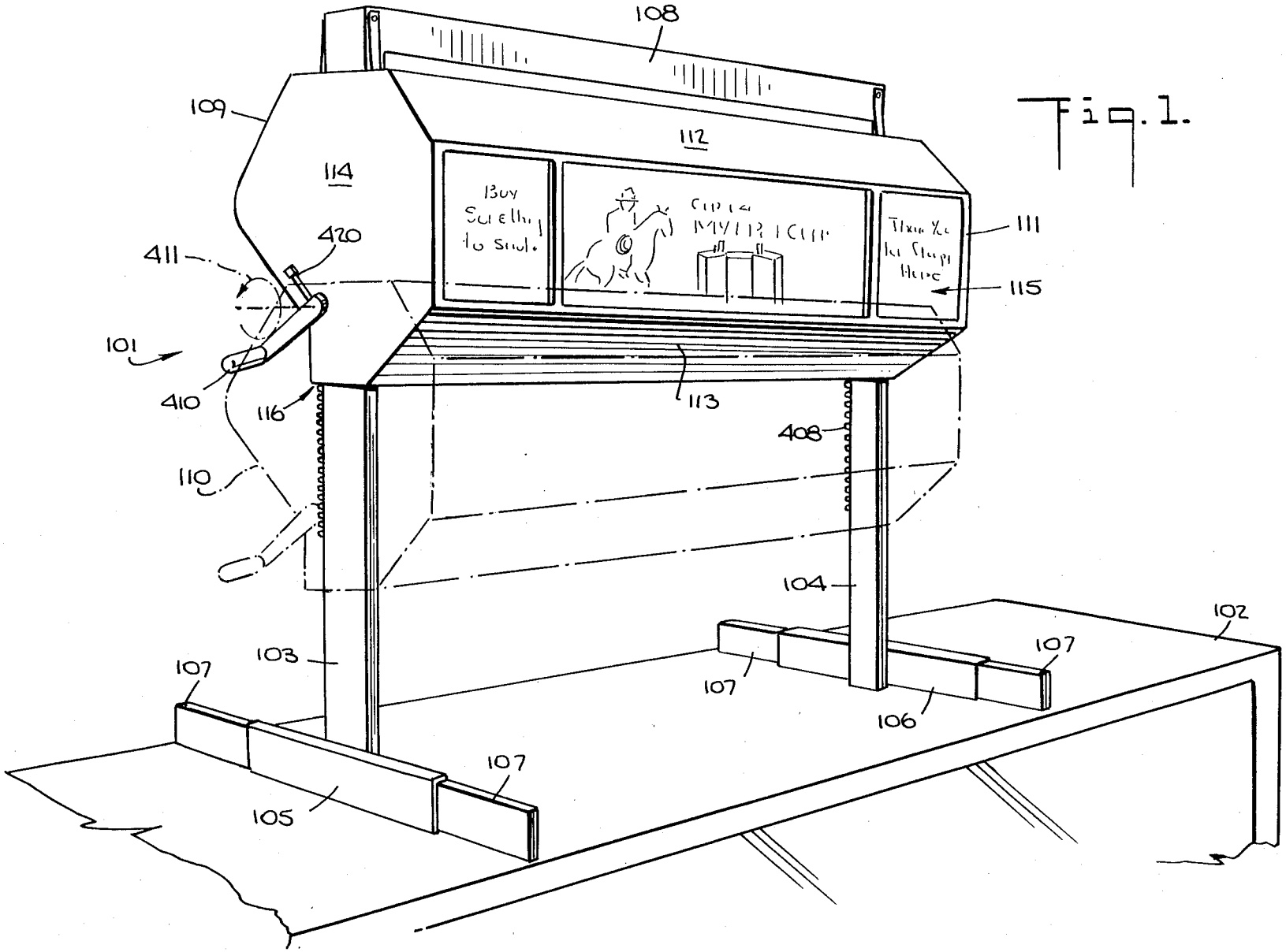
FIG. 1 is a front perspective view of the overhead cigarette merchandising unit of the present invention.

A preferred embodiment of the overhead cigarette merchandising unit of this invention is illustrated in FIGS. 1 through 4. The unit, indicated generally at 101 in FIG. 1, is shown mounted on counter 102. The unit is supported by upright posts 103, 104 attached to respective cross-pieces 105, 106. Telescoping extensions 107 of the cross-pieces provide greater stability, but can be retracted to reduce bulk during shipment or other movement of the unit. Uprights 103, 104 are braced at the top by cross-beam 108.

The main body of the unit is enclosure 109, shown in its uppermost position, and shown also in phantom at 110 near its lowermost position. The enclosure has a front panel 111, which faces the customers, a top panel 112, a bottom panel 113, a left side panel 114, and a right side panel (not shown). Front panel 111 can carry advertising or other messages, as indicated generally at 115.

Figure 2:
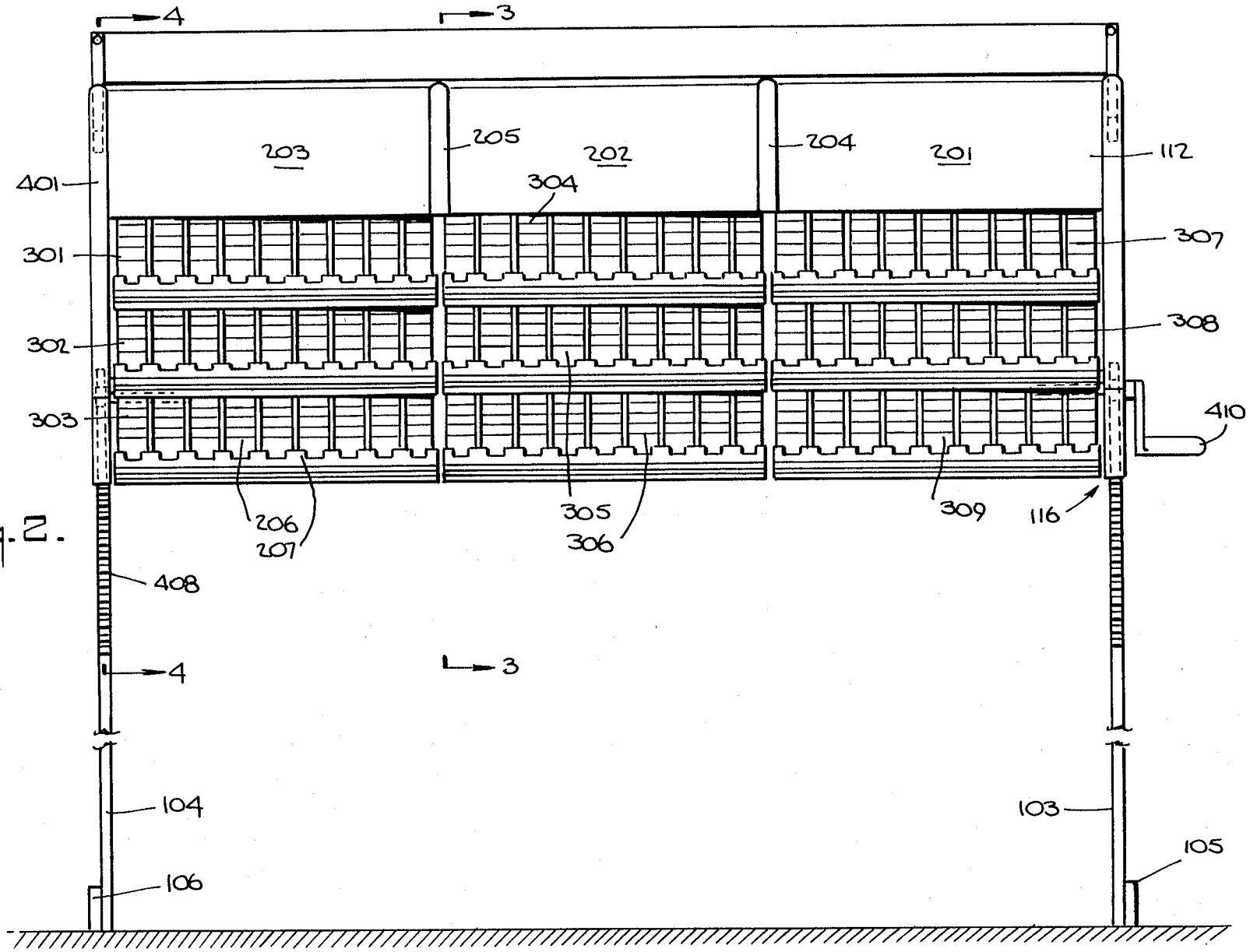
FIG. 2 is a rear elevational view of the overhead cigarette merchandising unit of the present invention.

The rear of enclosure 109 is shown in FIG. 2. Top panel 112, shown here in greater detail than in FIG. 1, is seen to be composed of three panels 201, 202, 203, separated by ribs 204, 205. The enclosure is seen to contain, in this embodiment, nine cigarette pack trays 301–309, shown more clearly in FIG. 3. Each tray shown has nine channels 206 for receiving rows of cigarette packs. Each channel illustrated has a capacity of fourteen packs 310, for a total capacity for the unit shown of $81 \times 14 = 1{,}134$ packs of cigarettes. At the front of each channel is thumb notch 207, which facilitates the removal of a cigarette pack 310 in the manner shown at 311.

Figure 3:
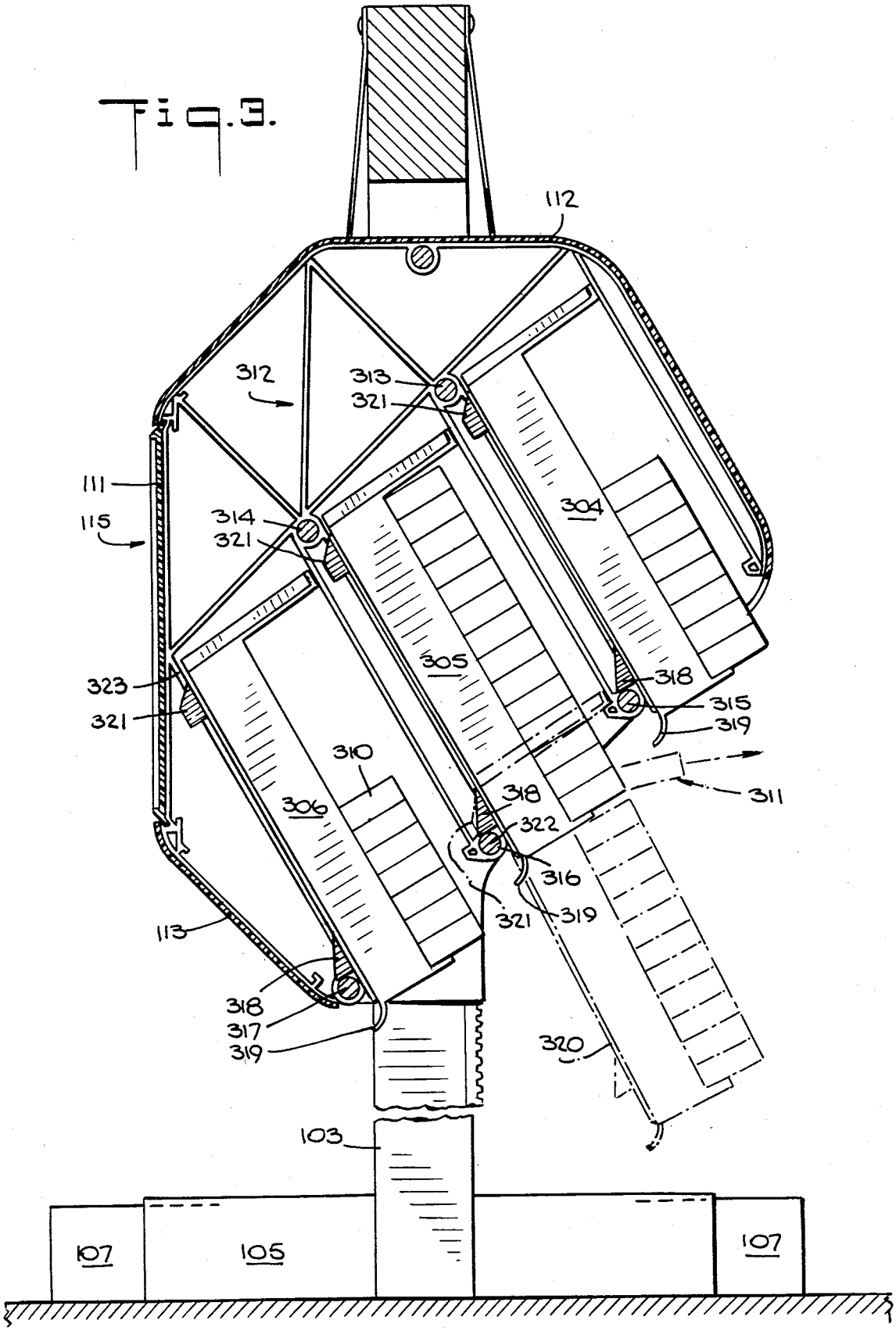
FIG. 3 is a cross-sectional view of the overhead cigarette merchandising unit of the present invention, taken along line 3—3 of FIG. 2.

Trays 301–309 are supported on a shelf-like framework indicated generally at 312. The rear of each tray in the upper and middle rows (trays 301, 302, 304, 305, 307 and 308) rests on upper cross-member 313 or 314, respectively, while the rear of each tray in the bottom row (trays 303, 306, and 309) rests against member 323 of framework 312. As can be seen in FIG. 3, the trays are supported in an inclined position, with the front of each tray resting on one of the lower cross-members 315, 316, 317. Triangular stops 318 depend from the front of the bottom of each tray, retaining the tray against sliding out of the enclosure by engagement with the respective lower cross-member for that tray.

The inclination of trays 301–309 provides gravitational feed of the cigarette packs. As a given pack is removed, as indicated at 311, the remainder of the packs in that channel slide downward so that a new pack takes the place of the one that was removed. When a channel is empty, it is easily restocked by lifting the tray by means of handle 319 so that triangular stop 318 is moved out of engagement with the lower cross-member. The tray can then be lifted completely out of the enclosure for restocking, or can be drawn down to the position shown in phantom at 320. In the event the latter option is selected, the rear of the tray rests on the lower cross-member during restocking, with safety stop 321, which depends from the rear of the bottom of the tray, engaging the cross-member to prevent accidental slippage of the tray out of the enclosure.

One of the primary advantages of the cigarette merchandising unit of this invention is its adaptability to varying height requirements, as dictated by both space limitations and personnel height. To provide adjustability to the physical limitations of a particular installation, uprights 103, 104 can be fashioned from telescoping members such as box beams and provided with retaining means (not shown) so as to be capable of discrete height adjustments. Further, if necessary, they can be mounted so that the unit can be suspended from the ceiling, although floor or counter mounting is preferred. For finer height adjustment in daily use after installation, such as at a shift change when the clerk on duty may be replaced by another of different height, a mechanism is provided allowing simple and convenient alteration of the height of the unit.

Figure 4:
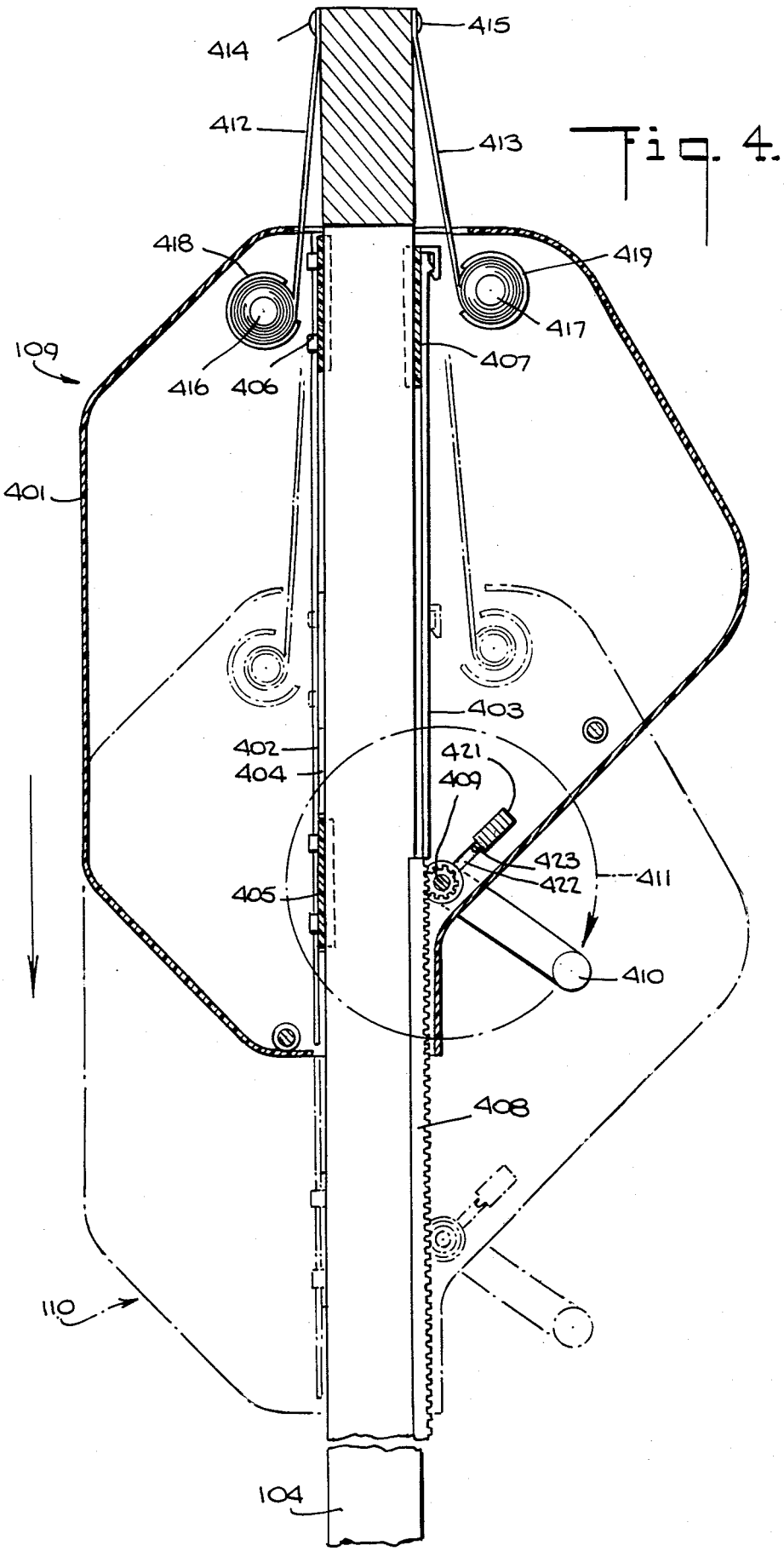
FIG. 4 is a cross-sectional view of the overhead cigarette merchandising unit of the present invention, taken along line 4—4 of FIG. 2.

The mechanism is illustrated in detail in FIG. 4, which is a cross-sectional view of the interior of the right end cap 401 of enclosure 109. An identical mechanism is found in the left end cap. The end cap is provided with ribs 402, 403 defining a passage 404 through which upright 104 passes. To minimize friction, passage 404 is made wider than upright 104, and is provided with spacers 405, 406, 407 to maintain upright 104 in proper alignment.

A gear rack 408 is provided on the rear face of upright 104 for engagement with pinion gear 409, which is journalled adjacent to passage 404. A similar rack and pinion arrangement is found on the left side of the unit at 116. The respective pinion gears 409 are joined by an interconnecting shaft 322 which passes through shelf cross-member 316, as shown in FIG. 3. Shaft 322 is fixedly connected to each of the pinion gears 409 so that the gears rotate in unison. The gears are rotated manually by crank 410, which is removable and is preferably connected to pinion gear 409 only when it is desired to operate the mechanism. Crank 410 can be connected at either end of enclosure 109, although shown in both FIG. 1 and FIG. 4 on the left side. Rotation of crank 410 in the direction shown by arrow 411 will lower the enclosure 109 to the position shown in phantom at 110, and lower, to the extent that the length of gear rack 408 will allow. Rotation in the opposite direction will raise the enclosure. Interconnecting shaft 322 is needed to insure that both ends of the enclosure move simultaneously, to prevent jamming of the unit.

Means are provided to retain enclosure 409 at any height selected. These means include, first, coiled flat springs 412, 413 attached to upright 104 at 414 and 415 respectively, and wound on self-lubricating bobbins (not shown) journalled for rotation on shafts 416, 417. Springs 412 and 413, which wind and unwind inside partial shields 418, 419, along with identical springs in the left end cap attached to upright 103, are chosen to have a restoring force equal to the weight of enclosure 109 when fully loaded with cigarettes. In that way, regardless of the height selected, the weight of the unit is exactly counterbalanced by the pull of the springs, so that it remains in that position. In addition, movement of the enclosure will require only enough force to overcome the friction within the lift mechanism. However, as cigarettes are sold, and the unit becomes lighter, it will tend to rise under the influence of the springs, and downward adjustment of the height of the enclosure will require extra force to overcome the upward bias of the springs. Therefore, additional retaining means are provided in the form of locking slides 420, 421 on the left and right sides, respectively, of enclosure 109. During movement of the unit, these slides, accessible from the outside of the enclosure, are kept at the position in which slide 421 is shown in FIG. 4. After the desired height has been selected, slide 421 is moved downward along slot 422, until tongue 423 engages the teeth of pinion gear 409, preventing the rotation thereof, thereby locking the enclosure at the selected height. Slide 420 functions similarly on the left side of the enclosure.

Longer enclosures can be accommodated according to this invention by providing additional upright supports at selected locations along the length of the enclosure. In such an embodiment, each such additional support should have associated with it a mechanism as described above, with all of the mechanisms linked by interconnecting shafts such as shaft 322.

The preferred material for the panels of enclosure 109 is medium impact styrene plastic, although any material commonly used for retail displays will suffice. The gears and associated parts are preferably formed of acetal plastic, while the trays are preferably formed from a transparent K-resin plastic, but here again any commonly used material will function equally well. The upright supports should be able to sustain the entire weight of the unit, and should, therefore, be made of a material capable of bearing a significant load, such as stainless steel or chrome plated mild steel. The coiled springs are by their nature limited to a material of suitable strength and elasticity, such as spring steel.

The cigarette merchandising display as described is versatile in its adaptability to changing physical constraints. It is also attractive and distinctive in appearance, presenting a profile quite different from those of the prior art. By angling off the corners of the enclosure, unused air space that would be inside the enclosure in other displays is eliminated, presenting a less bulky appearance and allowing more light to reach the counter area. The front face of the enclosure can carry advertising or other messages, or backlit displays, or can be left blank.

It will therefore be seen that this invention provides a distinctive and attractive overhead cigarette merchandising display which can be adjusted to any one of an infinite number of selected heights. It should be understood that the embodiment described herein is meant to be illustrative only, and that other adaptations are possible within the scope of the invention, which is to be limited only by the claims below.

I claim:

1. An overhead retail merchandising unit for cigarettes, comprising:

an elongated cigarette dispensing enclosure including a bottom wall, a front wall, a top wall and two side walls, and further having a plurality of generally upright passages therethrough;

a plurality of generally upright supports slidably received within said passages, each of said upright supports comprising two telescoping box beams and means for adjusting the height of said support to one of a plurality of discrete positions;

means for translating said enclosure vertically along each of said supports simultaneously to any one of an infinite number of selected heights for continuous fine adjustment after installation at one of said discrete positions; and means for retaining said enclosure in a desired position relative to said supports.

2. The overhead cigarette merchandising unit of claim 1, wherein said translation means comprises a respective gear rack secured to each of said supports, a respective pinion gear journalled on said enclosure adjacent to each of said passages for engagement with a respective one of said gear racks, means coupling said pinion gears for rotation in unison, and means for applying torque directly to said pinion gears and said coupling means to rotate said pinion gears in unison.

3. The overhead cigarette merchandising unit of claim 2, wherein said retaining means comprises means biasing said enclosure upwards, and locking means for engagement with each of said pinion gears for preventing the rotation thereof, said locking means comprising a respective locking slide mounted in a respective track within each of said side walls and partially exposed for manual translation along said track, each of said slides having a projection for insertion between two consecutive teeth of a respective one of said pinion gears.

4. The overhead cigarette merchandising unit of claim 3, wherein:

said coupling means comprises a shaft interconnecting said pinion gears, said shaft being fixedly secured to said pinion gears for rotation therewith;

said biasing means comprises at least one coiled spring associated with each of said supports, and attached to said support and to said enclosure; and said torque-applying means comprises a manual crank.

5. The overhead cigarette merchandising unit of claim 4, wherein said coiled springs exert an upward force equal to the weight of said enclosure when fully loaded with cigarettes.

6. The overhead cigarette merchandising unit of claim 1, wherein said enclosure comprises a plurality of cigarette pack containing means accessible from the rear of said enclosure, said pack containing means being removable for loading with cigarette packs.

7. The overhead cigarette merchandising unit of claim 6, further comprising a plurality of pairs of cross-members extending from one of said side walls to the other, one member of each of said pairs spaced above and forward of the other, said pairs defining a plurality of inclined shelf frames for receiving said pack containing means.

8. The overhead cigarette merchandising unit of claim 7, wherein said pack containing means are trays divided into a plurality of channels for receiving rows of cigarette packs and having a plurality of projections depending from the bottom thereof, the fronts of said trays being positioned at the rear of said inclined shelf frames, said trays being retained on said shelf frames by the engagement of said projections with said cross-members.

9. An overhead retail merchandising unit for cigarettes, comprising:

an elongated cigarette dispensing enclosure, including:

a bottom wall, a vertical front wall, a top wall and two side walls, said bottom wall inclined at a first oblique angle with respect to said front wall, said top wall having a horizontal topmost portion, a rearward portion inclined at a second oblique angle with respect to said topmost portion, and a forward portion inclined at said first oblique angle with respect to said front wall and at an angle complementary to said first oblique angle with respect to said topmost portion, and said front wall having means for displaying advertising thereon, a plurality of shelf frames inclined parallel to said rearward portion of said top wall, including a plurality of pairs of cross-members extending from one of said side walls to the other, one member of each of said pairs spaced above and forward of the other, and a plurality of cigarette-pack-containing trays, each of said trays being divided into a plurality of channels for receiving rows of cigarette packs and having a plurality of projections depending from the bottom thereof, said trays being supported on said inclined shelf frames and accessible from the rear of said enclosure, the fronts of said trays being positioned at the rear of said shelf frames, said trays being retained on said shelf frames by the engagement of said projections with said cross-members, and said trays being removable for loading with cigarette packs;

a plurality of generally upright passages through said enclosure and a plurality of generally upright supports each slidably received within a respective one of said passages, each of said supports comprising two telescoping box beams and means for adjusting the height of said support to any of a plurality of discrete positions;

means for translating said enclosure vertically along said supports simultaneously to any one of an infinite number of selected heights for continuous fine adjustment after installation at one of said discrete positions, including a respective gear rack secured to each of said supports, a respective pinion gear journalled on said enclosure adjacent to each of said passages for engagement with a respective one of said gear racks, a shaft interconnecting said pinion gears for rotation in unison, said shaft being fixedly secured to said pinion gears for rotation therewith, and a removable manual crank for applying torque directly to said pinion gears and said shaft to rotate said pinion gears in unison, said enclosure being adapted to receive said crank at either end thereof; and means for retaining said enclosure in a desired position relative to said supports, including:

at least one coiled leaf spring associated with each of said supports and attached to said support and to said enclosure for biasing said enclosure upwards, said springs exerting an upward force equal to the weight of said enclosure when fully loaded with cigarettes, and locking means for engagement with each of said pinion gears for preventing the rotation thereof, said locking means comprising a respective locking slide mounted in a respective track within each of said side walls and partially exposed for manual translation along said track, each of said slides having a projection for insertion between two consecutive teeth of a respective one of said pinion gears.

* * * * *

UNITED STATES PATENT AND TRADEMARK OFFICE

CERTIFICATE OF CORRECTION

PATENT NO. : 4,498,714

DATED : February 12, 1985

INVENTOR(S) : Lee Wiese

It is certified that error appears in the above-identified patent and that said Letters Patent is hereby corrected as shown below:

The sheets of Drawings consisting of Figures 1-3 should be deleted to appear as per the attached sheets.

Signed and Sealed this

*Fifth* Day of *November 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,498,714

DATED : February 12, 1985

INVENTOR(S) : Lee Wiese

It is certified that error appears in the above-identified patent and that said Letters Patent is hereby corrected as shown below:

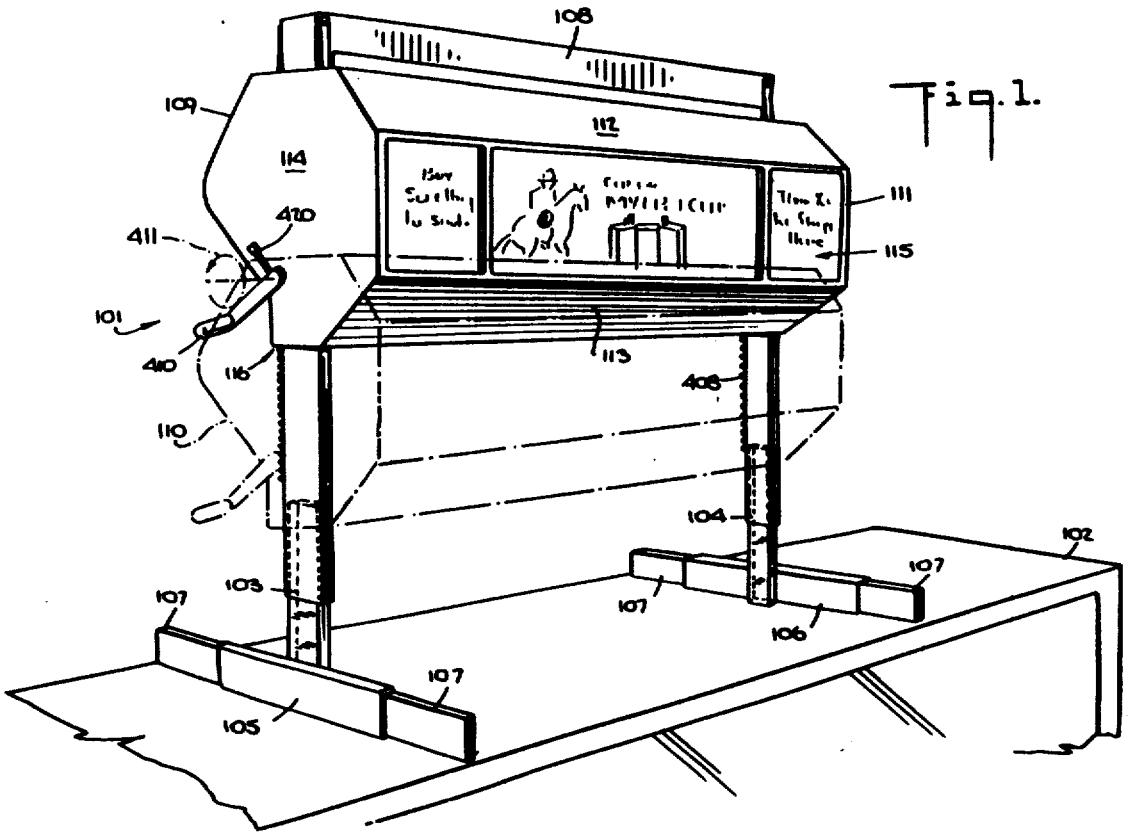

Fig. 1.

UNITED STATES PATENT AND TRADEMARK OFFICE

CERTIFICATE OF CORRECTION

PATENT NO. : 4,498,714

DATED : February 12, 1985

INVENTOR(S) : Lee Wiese

It is certified that error appears in the above-identified patent and that said Letters Patent is hereby corrected as shown below:

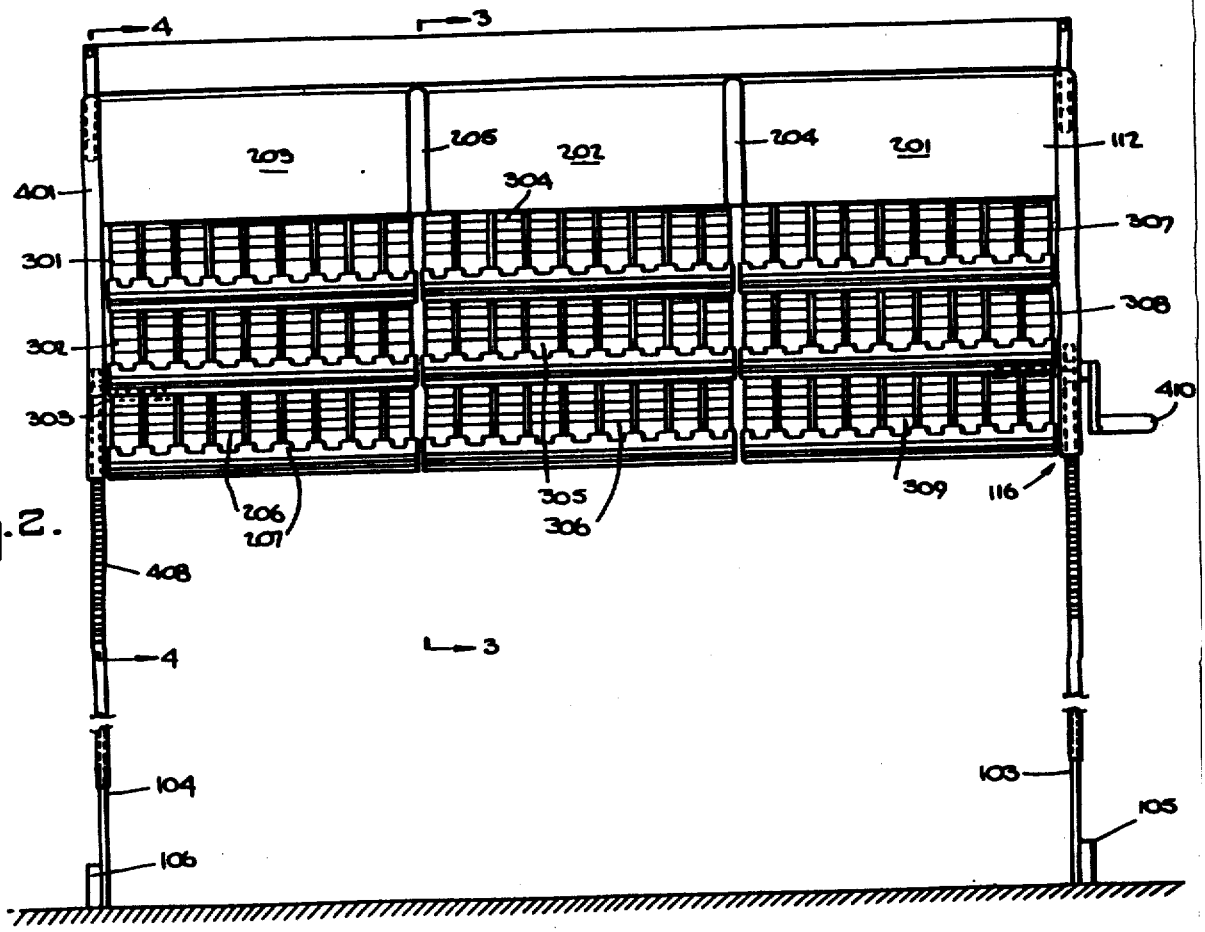

Fig. 2.

UNITED STATES PATENT AND TRADEMARK OFFICE

CERTIFICATE OF CORRECTION

PATENT NO. : 4,498,714

DATED : February 12, 1985

INVENTOR(S) : Lee Wiese

It is certified that error appears in the above-identified patent and that said Letters Patent is hereby corrected as shown below:

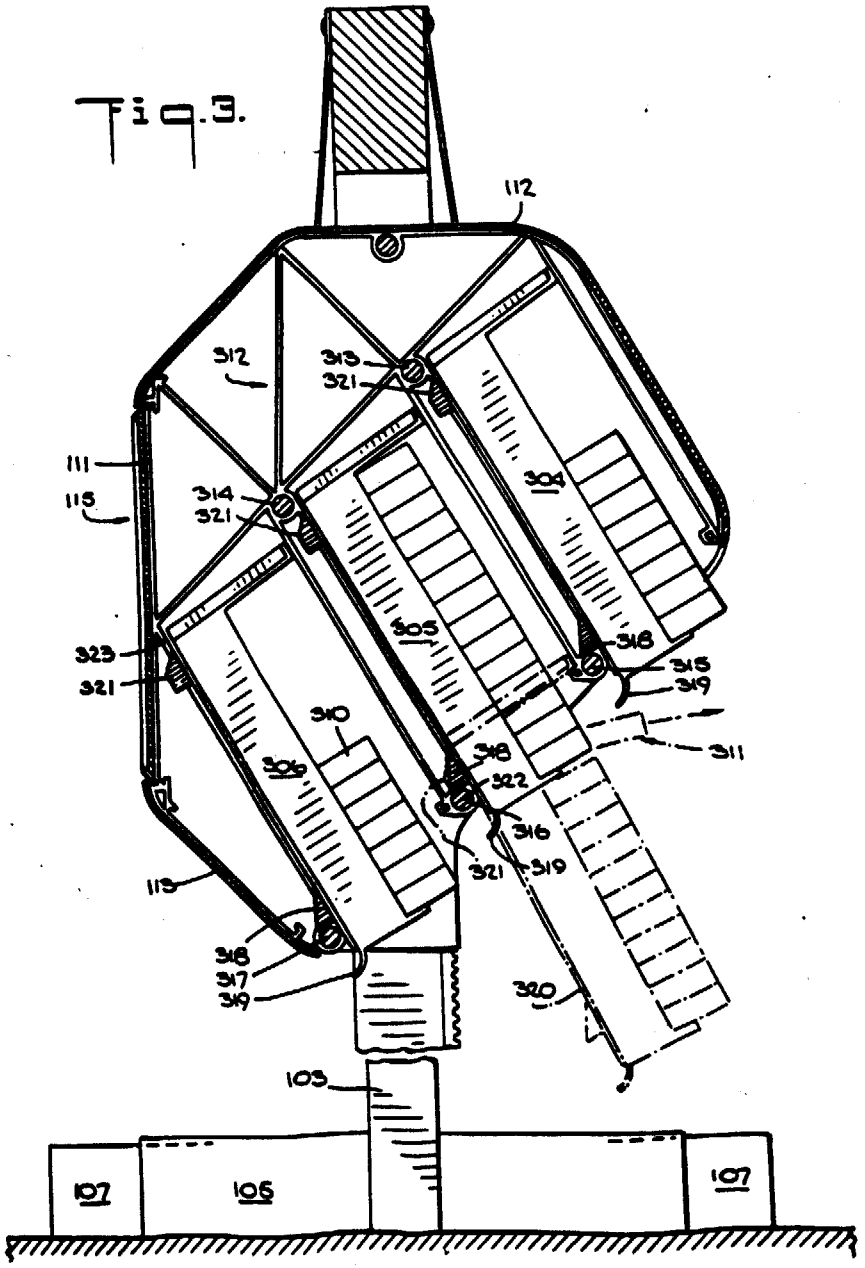

Fig. 9.